US005806741A

United States Patent [19]

Kirk

[11] Patent Number: 5,806,741

[45] Date of Patent: Sep. 15, 1998

[54] LOAD-CARRYING SYSTEM

[75] Inventor: John Kirk, Ashland, Mass.

[73] Assignee: The United States of America as represented by the Secretary of the Army, Washington, D.C.

[21] Appl. No.: 931,598

[22] Filed: Sep. 16, 1997

[51] Int. Cl.[6] ..... A45F 3/10

[52] U.S. Cl. ..... 224/634; 224/665

[58] Field of Search ..... 224/634, 628, 224/633, 636, 637, 660, 663, 665, 261, 262, 271, 189, 190, 196

[56] References Cited

U.S. PATENT DOCUMENTS

| | | | |
|---|---|---|---|
| 3,957,183 | 5/1976 | Gadberry . | |
| 4,194,656 | 3/1980 | Zufich . | |
| 4,307,826 | 12/1981 | Stewart | 224/634 |
| 4,318,502 | 3/1982 | Lowe et al. | 224/153 |
| 4,605,335 | 8/1986 | Otrusina | 403/348 |
| 4,645,465 | 2/1987 | Courtney | 441/40 |
| 4,973,277 | 11/1990 | Khanamirian | 441/88 |
| 5,014,359 | 5/1991 | Hanson | 2/94 |
| 5,016,794 | 5/1991 | Beagle, Jr. . | |
| 5,025,965 | 6/1991 | Smith . | |
| 5,184,763 | 2/1993 | Blaisdell et al. | 224/634 X |
| 5,247,707 | 9/1993 | Parker et al. | 2/102 |
| 5,604,958 | 2/1997 | Anscher | 24/3.1 |
| 5,609,278 | 3/1997 | Fresco | 224/634 X |
| 5,617,984 | 4/1997 | Fabel | 224/641 |
| 5,626,270 | 5/1997 | Tseng | 224/628 X |
| 5,639,005 | 6/1997 | Chouinard | 228/580 |

*Primary Examiner*—Renee S. Luebke
*Attorney, Agent, or Firm*—Vincent J. Ranucci

[57] ABSTRACT

A load carrying system comprising a pack frame and a waist-encircling belt. The pack frame is adapted for fastening around the body of a wearer and includes a top end, a bottom end and a male formation extending substantially downward from the frame bottom end. The male formation has an engagement portion. The waist-encircling belt has a wearer facing side, an exterior side, a pair of ends and a complementary pair of fasteners. Each fastener is attached to a respective end of the belt. The belt further includes a receptacle attached to the exterior side of the belt and located substantially midway between the belt ends. The receptacle has an opening and is sized for receiving the male formation. The load-carrying system further includes at least one interfering member attached to the receptacle and positioned within the receptacle opening. The interfering member is adapted for engaging the engagement portion of the male formation. The interfering member prevents the male formation from becoming dislodged from the receptacle when the pack frame is in a generally vertical orientation and allows the male formation to become dislodged from the receptacle when the orientation of the pack frame is less than generally vertical.

18 Claims, 4 Drawing Sheets

*Fig.5*

LOAD-CARRYING SYSTEM

The invention described herein may be manufactured, used and licensed by or for the Government for Governmental purposes without the payment to us of any royalty thereon.

BACKGROUND OF THE INVENTION

1. Field of the Invention

The present invention generally relates to a load-carrying system that uses a waist-encircling belt and a frame for supporting a backpack or other load.

2. Problem to be Solved

Conventional backpacks typically utilize a set of shoulder straps and a waist belt to secure the backpack to the user's torso. When a backpack waist belt is worn over other gear such as an equipment belt, vest or other load-bearing system, there is incompatibility between the backpack waist belt and the items supported by the equipment belt. Many conventional systems have been developed in an attempt to solve the aforementioned problem. One such system comprises a backpack that is directly attached to a load-bearing vest resulting in the vest serving as the support structure for the backpack. Such a system employs a rigid frame integrated into the vest in order to support the backpack. The backpack is attached to the vest by a complementary male/female connector combination that is activated by a cable pull on the front of the torso area. One disadvantage of such a system is that when the user doffs the backpack, the user is left with an uncomfortable rigid frame on the back which limits mobility and the range of motion of the vertebrae. Another disadvantage of such a system is that the cable activated connectors are expensive and become unreliable when they are exposed to snow, ice and mud. A further problem with this type of system is that the backpack does not employ a set of shoulder straps to properly distribute the load. The load is actually carried by the vest which offers poor support. Another conventional system uses quick-release hardware on the shoulder straps to allow the user to doff the backpack quickly. A disadvantage of such a system is that if the user wishes to quickly doff the backpack, he or she must release the fastening hardware of both the shoulder straps and the waist-belt. This can be a time consuming process. Another disadvantage of such a system is that if a waist belt is employed on the backpack, it will be incompatible with any other equipment belt worn around the waist. Another conventional system allows a backpack to be attached directly to a load-bearing vest without the need for a separate waist-belt. However, a disadvantage of such a system is that if the user desires to rapidly doff the backpack and frame from the vest, the user must first remove the vest. Such a system is both inconvenient and time consuming to use.

Bearing in mind the problems and deficiencies of conventional load-carrying systems discussed above, it is an object of the present invention to provide a load-carrying system that allows a user to quickly doff a backpack without doffing or adjusting a vest and/or waist belt worn under the backpack.

It is another object of the present invention to provide a load-carrying system that eliminates the incompatibility discussed above between backpack waist belts and equipment-carrying belts.

It is a further object of the present invention to provide a load-carrying system that is inexpensive to manufacture.

Other objects and advantages of the present invention will be apparent to one of ordinary skill in the art in light of the ensuing description of the present invention.

SUMMARY OF THE INVENTION

The present invention is directed to a load-carrying system that utilizes a waist-encircling belt and a pack frame. The waist-encircling belt may be worn alone or as part of a vest or harness. Furthermore, the waist-encircling belt may be worn without the pack frame. When the waist-encircling belt is attached to a vest or harness, the belt serves both the vest or harness and the backpack frame. The use of only one belt for both the vest and pack frame eliminates incompatibility problems that occur when separate belts are used for the vest or harness and backpack. The present invention allows the user to quickly doff the backpack without the need to doff the waist-encircling belt, vest, or harness. This prevents the user from having to lose valuable equipment, which is necessary for the user's function or mission, that may be attached to the belt, vest or harness.

The backpack frame includes a quick-release shoulder strap and a male formation or probe located at the bottom of the frame. The waist belt includes a female receptor or receptacle located on the rear portion of the belt and located above the buttocks of the user. The receptacle is configured to receive the male formation located on the backpack frame. As the user dons the backpack frame using the quick-release shoulder straps, the male formation is lowered into a top opening of the receptacle. The receptacle also includes at least one retention clip located within the opening of the receptacle. As the male formation is lowered into the receptacle, the frame passes over the retention clip thereby depressing the clip. When the male formation reaches the bottom of the receptacle, the clip returns to its original position. The retention clip, when in its original position, holds the male formation in place so that it cannot bounce up and out of the receptacle when the pack frame is in a general vertical orientation. When the user desires to release the frame with the backpack, the user disengages the quick-release straps. The frame and backpack then fall away from the user hinging or pivoting about the receptacle on the waist belt. As the frame falls away from the user's back, the male formation moves or diverges away from the retention clip thereby resulting in the male formation becoming completely dislodged from the receptacle. The frame is then free to completely fall away from the user.

BRIEF DESCRIPTION OF THE DRAWINGS

The features of the invention are believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DETAILED DESCRIPTION OF THE INVENTION

In describing the preferred embodiments of the present invention, reference will be made herein to FIGS. 1–7 of the drawings in which like numerals refer to like features of the invention.

Figure 1:
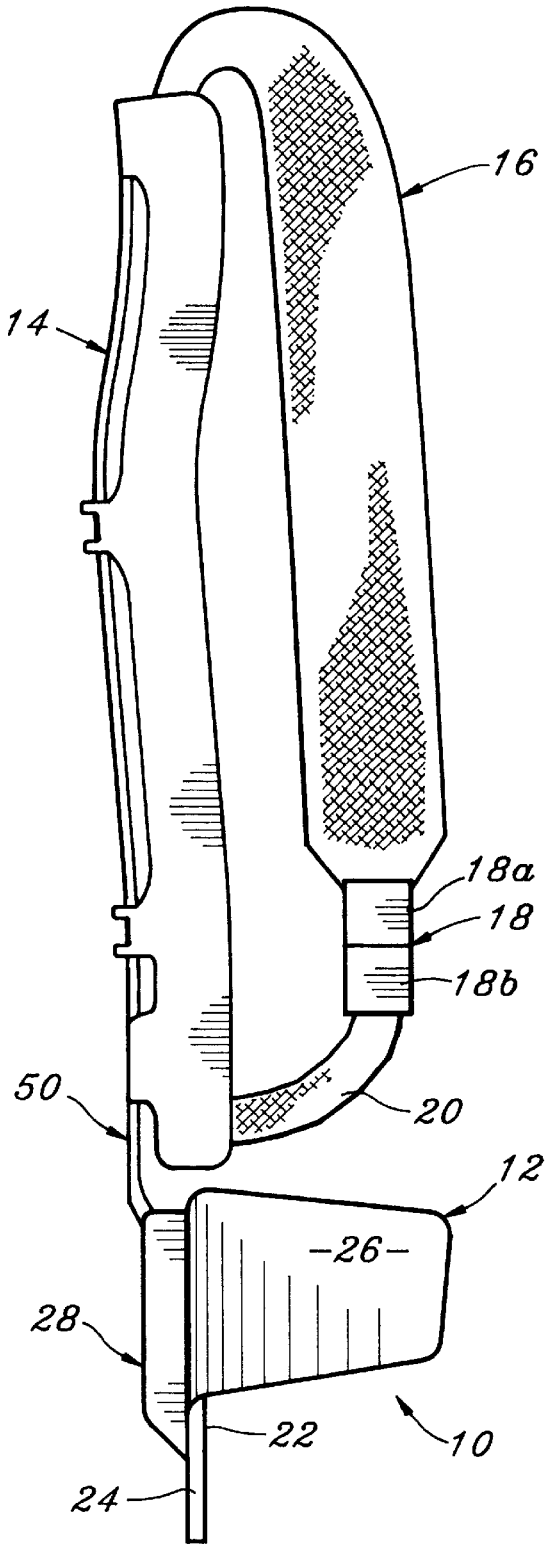
FIG. 1 is a side-elevational view of load-carrying system of the present invention.

Referring to FIG. 1, there is shown load-carrying system 10 of the present invention. Load carrying system 10 of the present invention generally comprises waist-encircling belt 12, pack frame 14, shoulder straps 16, quick-release hardware 18 and lower straps 20. It is to be understood that belt 12 can be a stand-alone item or as part of or attached to a vest or harness.

Figure 2A:
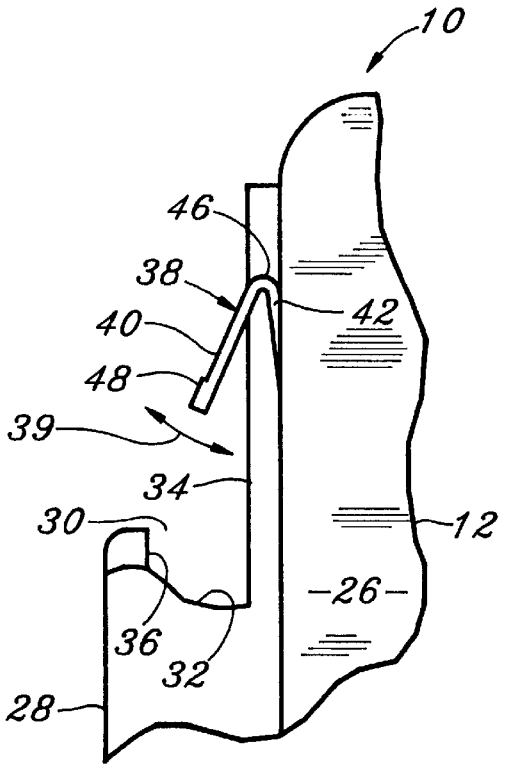
FIG. 2A is an enlarged side-elevational view of a receptacle attached to a waist belt as depicted in FIG 1.
Figure 2B:
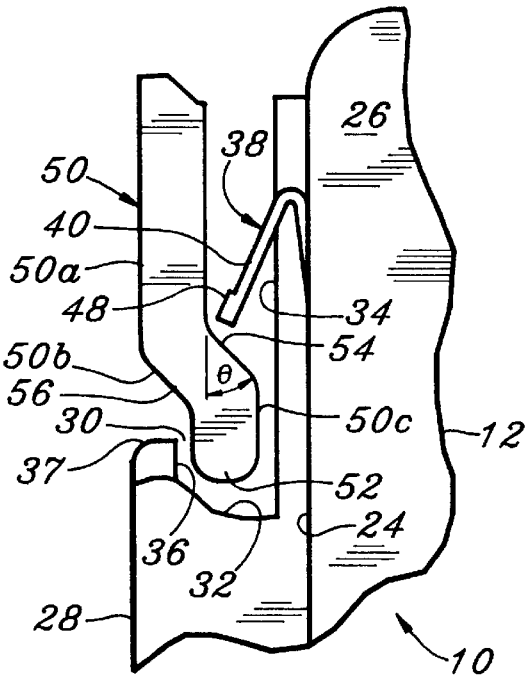
FIG. 2B is an enlarged side-elevational view of the interconnection between a male formation attached to a pack frame, depicted in FIG. 2A.

Waist-encircling belt 12 has inner side 22 facing the wearer or user and an exterior side 24. Belt 12 also comprises a pair of ends, one of which is designated by numeral 26 while the other end is not shown. Adjustable complementary fasteners (not shown), which are well known in the art, are fastened to the ends of belt 12 to allow the wearer to secure belt 12 around the wearer's waist. Referring to FIGS. 1 and 2, belt 12 further comprises female socket or receptacle 28. Receptacle 28 is attached to exterior side 24 of belt 12 and is located substantially midway between the ends of belt 12 (see FIG. 7). When the user fastens belt 12 around the user's hips, receptacle 28 is positioned just above the user's buttocks. Receptacle 28 has a substantially rectangular shape. As shown in FIG. 2, receptacle 28 has a top opening, indicated generally by numeral 30 in FIG. 2A, bottom surface 32, rear wall 34, front wall 36 and a pair of opposing side walls contiguous with rear wall 34 and front wall 36 as shown in FIG. 2A and FIG. 2B. Front wall 36 has rounded top portion 37. Bottom surface 32 is pitched or sloped for reasons which will be discussed below. As an alternative embodiment, receptacle 28 or interfering member 38 can allow a slight pivot, lateral motion from shoulder to shoulder, of frame 14 to provide improved mobility of the user's torso in side-to-side motions.

Referring to FIG. 2, receptacle 28 further includes interfering member or retention clip 38 that is attached conveniently, for example to rear wall 34. Retention clip 38 may also be located, for example, on opposing walls or on front wall 36. Interfering member 38 is resilient and can move bi-directionally as indicated by arrow 39. Interfering member 38 may be any convenient shape. In a preferred embodiment, interfering member 38 has a substantially V-shaped body portion including opposed sides 40 and 42 and closed end 46 that connects sides 40 and 42. Side 40 has end portion 48, the purpose of which will be discussed below. Interfering member 38 is positioned such that the body portion is upside down, i.e. closed end 46 is above sides 40, 42 and sides 40, 42 extend downwardly. Side 42 of interfering member 38 is attached to inner wall 34 of receptacle 28. Side 42 can also be integrally formed with inner wall 34. In a preferred embodiment, interfering member 38 is formed from a spring metal or molded plastic material. In an alternate embodiment, more than one interfering member may be utilized.

Figure 7:
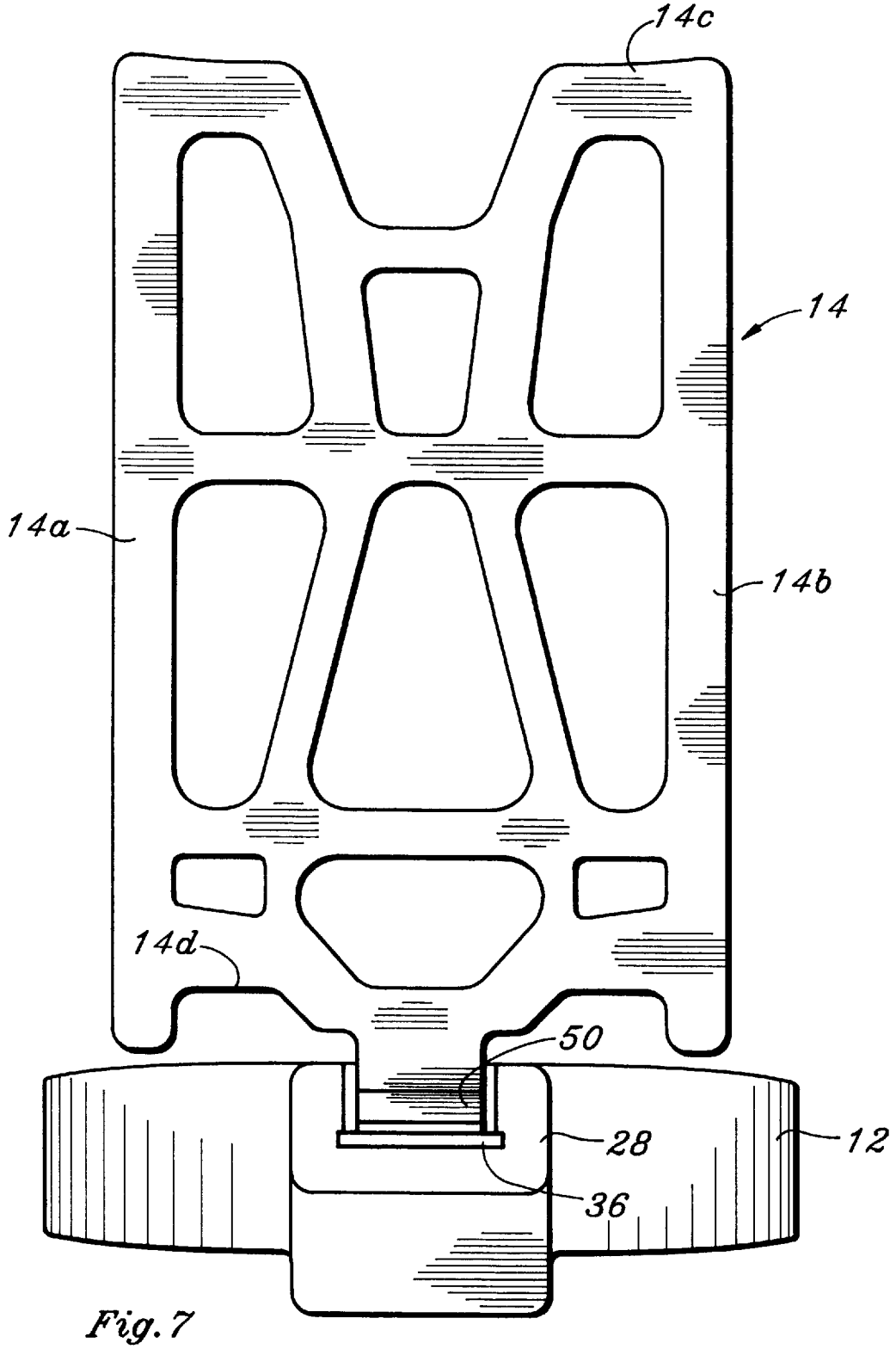
FIG. 7 is a front elevational view of the load-carrying system of the present invention.

Referring to FIGS. 1, 2B and 7, frame 14 is configured to support various types of backpacks or other devices configured to hold items. Frame 14 is lightweight, substantially rigid and has sides 14*a*, 14*b*, top end 14*c* and bottom end 14*d*. Frame 14 may be fabricated from materials such as plastic, wood, aluminum, rubber, graphite or other composite materials. Frame 14 further includes male formation or probe 50 located on bottom end 14*d* of frame 14 and located substantially midway between ends 14*a* and 14*b* of frame 14 (see FIG. 7). Male formation 50 extends generally downward from bottom end 14*d*. Male formation 50 comprises main portion 50*a*, intermediate portion 50*b*, end portion 50*c* and distal end 52. Male formation 50 is sized for insertion into receptacle 28. Intermediate portion 50*b* is angulated with respect to main portion 50*a* by angle θ. Although angle θ may vary to suit any construction of the invention, in a preferred embodiment, θ is between about 30° and 50°. End portion 50*c* is angulated with respect to intermediate portion 50*b*. In a preferred embodiment, the longitudinal axes of main portion 50*a* and end portion 50*c* are substantially parallel. However, the relationship of the axes to each other may vary to suit any variation of the construction of the invention. The angulation of intermediate portion 50*b* and end portion 50*c* provides surface 54 for engagement with end portion 48 of side 40 of interfering member 38. The angulation of intermediate portion 50*b* and end portion 50*c* also provides surface 56, the purpose of which will be discussed below.

Referring to FIGS. 1 and 2, as the user dons frame 14 using shoulder straps 16, male formation 50 is slidably disposed within receptacle 28. As male formation 50 slides into opening 30 of receptacle 28, male formation 50 passes over and depresses resilient interfering member 38. When male formation 50 is completely disposed within receptacle 28, distal end 52 contacts bottom surface 32 of receptacle 28 and interfering member 38 returns back to its original position. When male formation is completely disposed within receptacle 28, end portion 48 of interfering member 38 is in a confronting relationship with surface 54 of intermediate portion 50*b*. Sloped or angled bottom surface 32 of receptacle 28 prevents excessive lateral movement of male formation 50, i.e. movement between rear wall 34 and front wall 36.

If frame 14 is fastened to the user and male formation 50 exhibits any upward movement with respect to receptacle 28, interfering member 38 will engage surface 54 of male formation 50 to prevent male formation 50 from becoming dislodged from receptacle 28. If belt 12 exhibits downward movement with respect to male formation 50, end portion 48 of interfering member 38 will engage surface 54 of male formation 50 to prevent male formation 50 from becoming dislodged from receptacle 28. Thus, interfering member 38 prevents male formation 50 from sliding or bouncing out of receptacle 28 due to the user's movement, i.e. walking, running, bending, crawling, etc.

Figure 3:
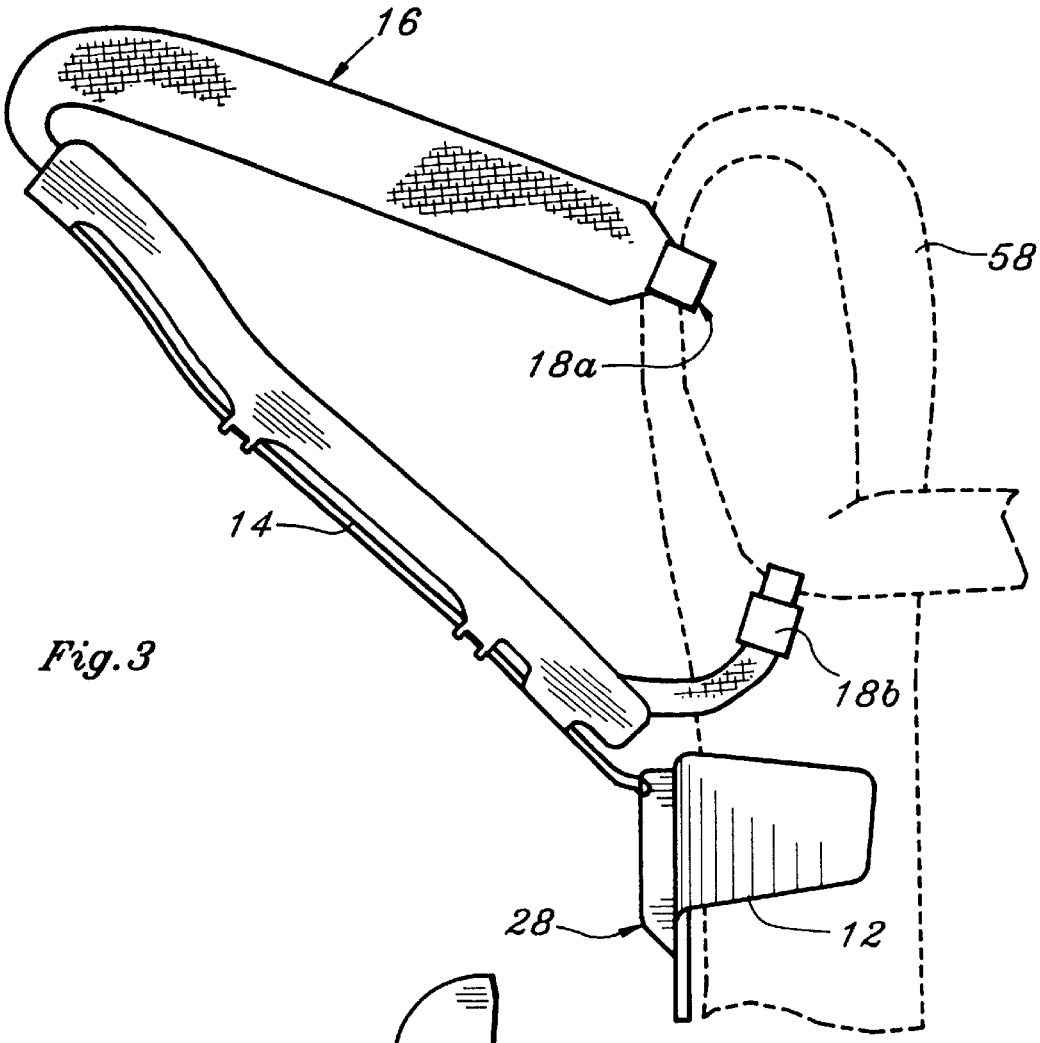
FIG. 3 is a side-elevational view illustrating the motion of the pack frame with respect to the user when fastening straps attached to the frame are released.
Figure 4:
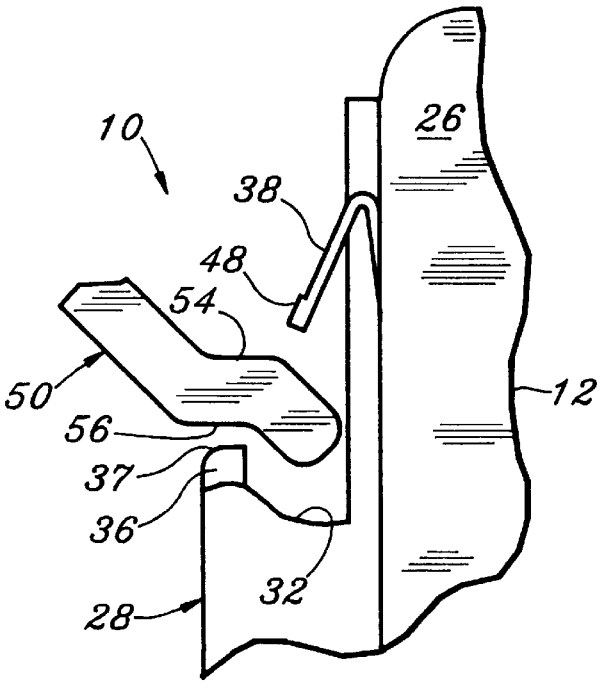
FIG. 4 is an enlarged side-elevational view illustrating the movement of the male formation with respect to the receptacle as the pack frame falls away from the user as illustrated in FIG. 3.

Referring to FIG. 1, when frame 14 is attached to the user, frame 14 and male formation 50 are in a generally vertical orientation. Referring to FIGS. 3 and 4, when the user, indicated by numeral 58, desires to release the frame from the user's back and waist-belt 12, the user manipulates quick-release hardware 18 to separate portions 18*a* and 18*b*. As a result, frame 14 falls away from user 58 hinging or pivoting about receptacle 28. As shown in FIGS. 3 and 4, when quick-release hardware portions 18*a* and 18*b* are separated and frame 14 falls away from user 58, male formation 50 rolls dorsally out of receptacle 28 and in the process, pivots about top portion 37 of front wall 36. As male formation 50 pivots about front wall 36, engagement surface 54 moves or diverges away from a confronting relationship with end portion 48 of interfering member 38 thereby preventing interfering member 38 from interfering with the movement of male formation 50. Thus, when the orientation of male formation 50 is less than generally vertical, interfering member 38 does not prevent male formation 50 from becoming dislodged from receptacle 28. Referring to FIG. 2B, the angulation of intermediate portion 50*b* with respect to main portion 50*a* facilitates the pivoting movement of intermediate portion 50*b* about front wall 36. The rounded shape of top portion 37 facilitates smooth pivoting action.

Figure 5:
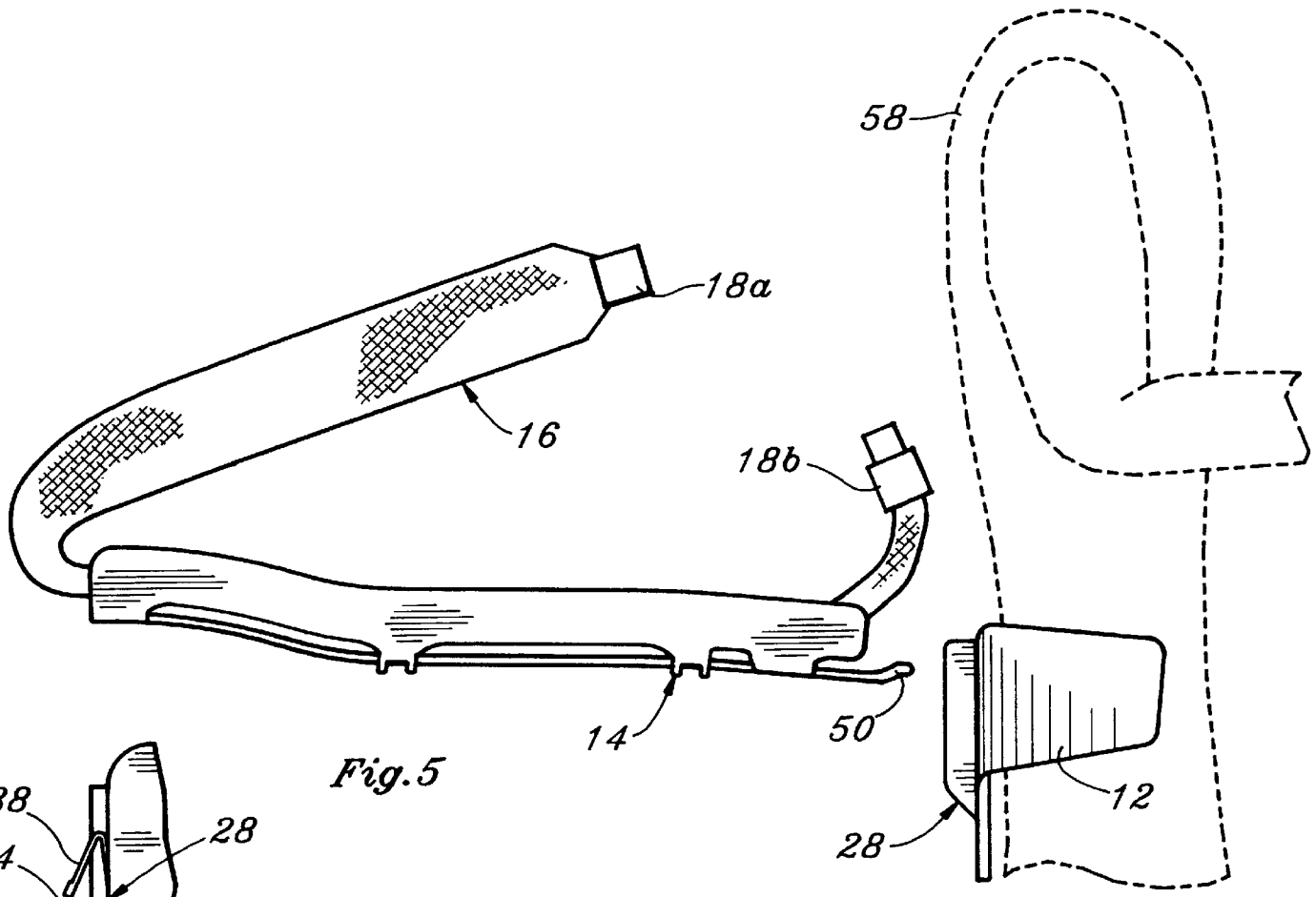
FIG. 5 is a side-elevational view, similar to FIG. 3, illustrating how the pack frame falls completely free of the waist belt.
Figure 6:
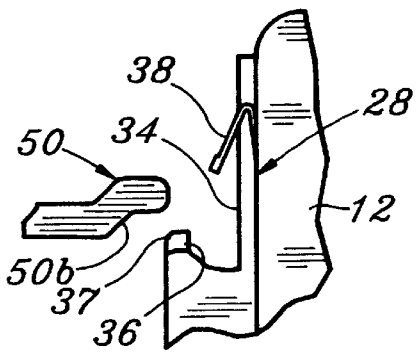
FIG. 6 is an enlarged side-elevational view illustrating the disengagement of the male formation from the receptacle when the pack frame falls away from the user.

Referring to FIGS. 5 and 6, when frame 14 reaches a predetermined angular orientation with respect to belt 12 or the user's back, male formation 50 becomes completely disengaged from receptacle 28 and free of the user. In a preferred embodiment, (i) the position of interfering member 38 upon rear wall 34, (ii) the size of interfering member 38, and (iii) the degree to which intermediate portion 50*b* is angulated cooperate to result in the aforementioned predetermined angular orientation being between about 30° and 90°, inclusive. It is to be understood that a greater range of angular orientation may be achieved by modifying factors (i)–(iii) discussed above.

The present invention solves the problem of incompatibility between a waist-encircling belt for carrying equipment and a belt attached to conventional backpacks. As shown by the discussion above, the present invention uses only waist-encircling belt 12 to support a pack frame and other equipment. Waist encircling belt 12 may be worn alone or with a vest or harness and may be attached to the vest or harness. Furthermore, belt 12 may be used with or without a pack frame. If belt 12 is used without a pack frame, then a suitable cover may be used to cover receptacle 28 to prevent the entry therein of foreign particles or debris that could damage receptacle 28 or interfering member 38.

The present invention may be used in many applications that require the user to carry a load on his or her back in addition to a waist-encircling belt, harness or vest that may be supporting other equipment. The present invention has many military, sports and recreational applications. For example, the present invention may be used by infantry personnel who must be able to quickly separate themselves from their backpacks but without losing any equipment attached to their belts, harnesses or vests. Such equipment might include ammunition clips, grenades, canteens, first aid supplies, side-arms, bayonets, etc. Typical situations that require infantry personnel to quickly jettison their backpack and frame include enemy ambush, hand-to-hand combat, river or stream crossings and facilitation of escape and evasion maneuvers when being pursued by enemy ground units. The present invention may also be used with SCUBA equipment thereby allowing divers to quickly separate themselves from their oxygen tanks in an emergency situation.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A load carrying system comprising:

a pack frame adapted for fastening around the body of a wearer, the frame having a top end, a bottom end and a male formation extending substantially downward from the frame bottom end, the male formation having an engagement portion;

a waist-encircling belt having a wearer facing side, an exterior side, a pair of ends and a complementary pair of fasteners, each of which being attached to a respective end of the belt, the belt further including a receptacle attached to the exterior side of the belt substantially midway between the belt ends, the receptacle having an opening and being sized for receiving the male formation; and at least one interfering member attached to the receptacle and positioned within the receptacle opening, the interfering member adapted for engaging the engagement portion of the male formation, the interfering member preventing the male formation from becoming dislodged from the receptacle when the pack frame is in a generally vertical orientation and allowing the male formation to become dislodged from the receptacle when the orientation of the pack frame is less than generally vertical.

2. The load-carrying system according to claim 1 wherein the pack frame includes quick-release fastening straps for fastening around the user's body.

3. The load carrying system according to claim 1 wherein the waist-encircling belt further comprises a vest to be worn by a user.

4. The load carrying system according to claim 1 wherein the waist-encircling belt further comprises a harness to be worn by a user.

5. The load carrying system according to claim 1 wherein the receptacle has sidewalls substantially perpendicular to the waist-encircling belt.

6. The load carrying system according to claim 5 wherein the interfering member comprises a flexible tab connected to the sidewalls.

7. The load carrying system according to claim 1 wherein the receptacle has a rear wall adjacent the wait-encircling belt.

8. The load carrying system according to claim 7 wherein the interfering member comprises a flexible tab connected to the rear wall.

9. The load carrying system according to claim 8 wherein the interfering member has an end portion in a confronting relationship with the engagement portion of the male formation when the male formation is substantially disposed within the receptacle and the pack frame is in a generally vertical orientation, the engagement portion diverging away from a confronting relationship with the end portion of the interfering member when the orientation of the pack frame is less than generally vertical.

10. The load carrying system according to claim 1 wherein the interfering member is resilient, the interfering member having a normal position and a depressed position, the male formation forcing the interfering member into the depressed position as the male formation is inserted into the receptacle, the interfering member returning to the normal position when the male formation is substantially disposed within the receptacle.

11. The load carrying system according to claim 10 wherein the resilient interfering member is fabricated from a spring metal.

12. The load carrying system according to claim 10 wherein the resilient interfering member is fabricated from plastic material.

13. The load carrying system according to claim 1 wherein the engagement portion is in a confronting relationship with the interfering member when the pack frame is in a generally vertical orientation, the engagement portion diverging away from a confronting relationship with the interfering member when the orientation of the pack frame is less than generally vertical.

14. The load carrying system according to claim 13 wherein the receptacle has a rear wall adjacent the waist-encircling belt and the male formation comprises a main portion, an intermediate portion attached and angulated with respect to the main portion, and an end portion attached and angulated with respect to the intermediate portion, the intermediate portion being angulated in the general direction of the receptacle rear wall when the male formation is disposed within the receptacle, the intermediate portion defining the engagement portion of the male formation.

15. The load carrying system according to claim 14 wherein the main and end portions of the male formation have longitudinal axes that are substantially parallel.

16. The load-carrying system according to claim 14 wherein the receptacle has a front wall opposing the rear wall, the front wall having a top portion and a height that is less than the height of the rear wall, the male formation pivoting about the front wall top portion when the pack frame is released from the user and the pack frame falls away from the user's back, the engagement portion of the male formation diverging away from a confronting relationship with the interfering member when pack frame falls away from the user thereby allowing the male formation to become completely dislodged from the receptacle.

17. The load carrying system according to claim 16 wherein the pivot point is generally defined by the intermediate portion of the male formation and the top portion of the front wall of the receptacle.

18. The load carrying system according to claim 17 wherein the top portion of the front wall is rounded to facilitate the pivoting of the intermediate portion about the top portion of the front wall.

* * * * *